US005855469A

United States Patent [19]

McConnell

[11] Patent Number: 5,855,469

[45] Date of Patent: Jan. 5, 1999

[54] END SEAL DESIGN FOR BLOWER

[75] Inventor: Kenneth G. McConnell, Ames, Iowa

[73] Assignee: Iowa State University Research Foundation, Inc., Ames, Iowa

[21] Appl. No.: 895,658

[22] Filed: Jul. 17, 1997

[51] Int. Cl.[6] ..... F01D 5/00; F03B 11/00

[52] U.S. Cl. ..... 415/171.1; 415/172.1; 415/173.6; 415/206

[58] Field of Search ..... 415/170.1, 171.1, 415/172.1, 173.1, 206, 173.6

[56] References Cited

U.S. PATENT DOCUMENTS

| | | | |
|---|---|---|---|
| 923,914 | 6/1909 | Watson | 415/206 |
| 3,070,287 | 12/1962 | Eck | 415/206 X |
| 3,627,440 | 12/1971 | Wood | 415/206 X |
| 4,245,965 | 1/1981 | Brown | 415/172.1 X |
| 4,432,694 | 2/1984 | Kuroda et al. | 415/172.1 X |
| 4,664,592 | 5/1987 | Grzina | 415/171.1 X |
| 4,773,819 | 9/1988 | Gurth | 415/206 X |
| 4,884,946 | 12/1989 | Belanger et al. | 415/206 |
| 4,917,572 | 4/1990 | Van Houten | 415/206 |
| 5,025,930 | 6/1991 | Barthelmess | 415/171.1 X |
| 5,104,541 | 4/1992 | Daniel | 415/206 X |
| 5,352,089 | 10/1994 | Tokunaga et al. | 415/206 |
| 5,536,140 | 7/1996 | Wagner et al. | 415/206 X |

FOREIGN PATENT DOCUMENTS

| | | | |
|---|---|---|---|
| 2102886 | 2/1983 | United Kingdom | 415/173.1 |

*Primary Examiner*—John E. Ryznic

*Attorney, Agent, or Firm*—Zarley, McKee, Thomte, Voorhees & Sease

[57] ABSTRACT

An improved blower of the squirrel cage type having an end seal ring that substantially encloses the inlet ends of the blower blades so to prevent air accelerated by the impeller from recirculating into the air inlet and onto the blower blades. The invention also includes the following: a cylinder that extends from the end seal ring and beyond the air inlet to prevent escaping air from recirculating into the air inlet; an axial ring disposed between the housing and the end seal to impede the flow of air that recirculates into the air inlet; and an end seal blade disposed between the end seal ring and the housing that creates a counter pressure to force leakage air away from the air inlet and toward the air outlet. The aforementioned are practiced in combination with good blade angle design where the entry angle of the blade is such that air flows smoothly onto the blade at a specific design flow rate.

16 Claims, 3 Drawing Sheets

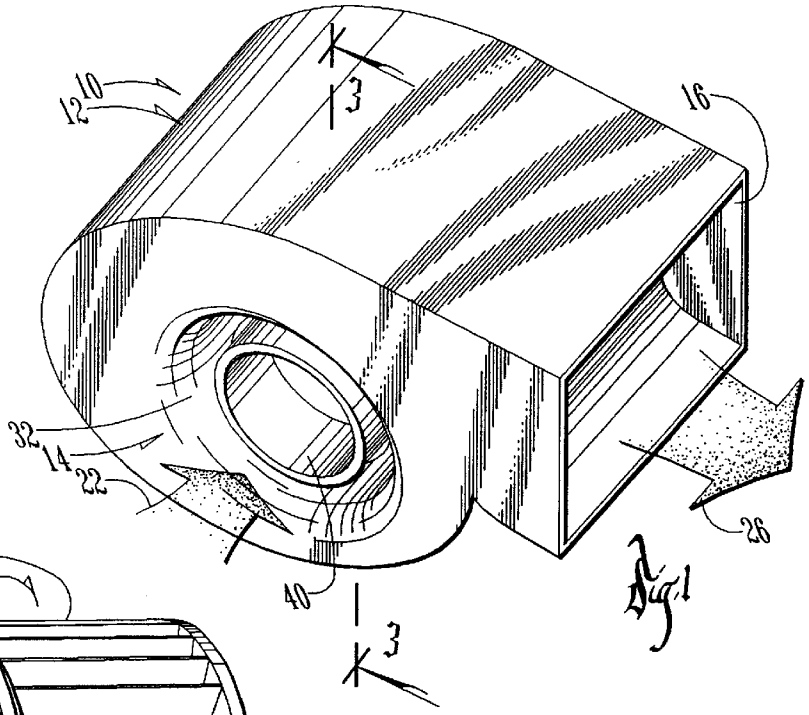
Fig. 1
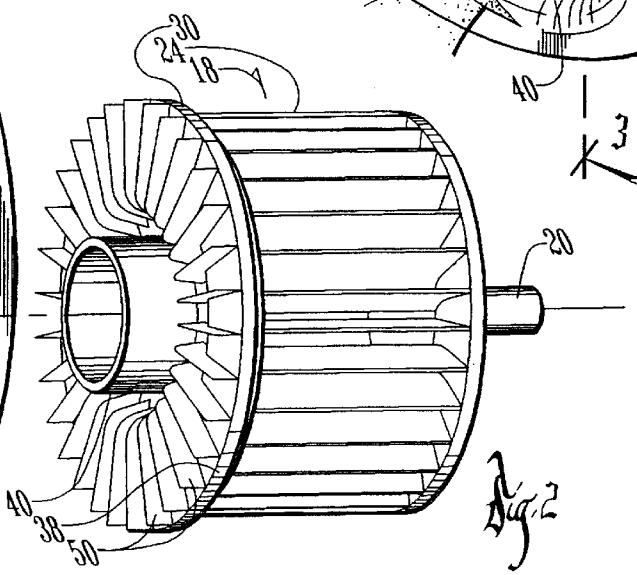
Fig. 2
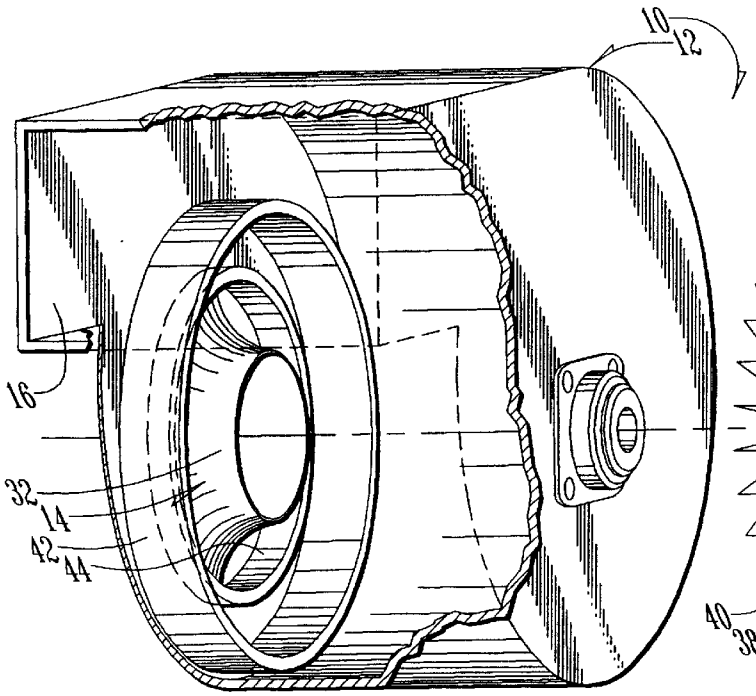

END SEAL DESIGN FOR BLOWER

BACKGROUND OF THE INVENTION

The present invention relates to air circulation devices and, more particularly, air circulation devices of the squirrel cage type. Centrifugal fans or blowers, also commonly referred to as squirrel cage blowers, are ubiquitous. They are used in such things as home appliances, office equipment, and automobile heater/AC units. The operating principal is the same for all centrifugal blowers. The air is drawn in at the inlet by a rotating impeller which is driven by a motor and contains a number of blower blades spaced apart and arranged in a circular pattern. On flowing through passages between the blower blades, the air is given an acceleration and emerges at an outlet under pressure from the blower housing.

Although such blowers have many desirable features, they suffer from several common problems. Air often flows around the end of the impeller and back into air inlet of the blower and onto the blower blades. Because there is little or nor seal to prevent air from flowing back into the blower, significant amounts of air recirculates into the blower's air inlet, which in turn causes chaotic air flow at the inlet side of the blades. Consequently, there is an inordinate amount of vibration and noise created because the air cannot flow onto the blower blades in a smooth and orderly manner. Thus, there is a need in the art for an improved blower of the squirrel cage type that effectively reduces or eliminates the back flow and recirculation of air into the air inlet.

Prior art squirrel cage blowers are also often characterized by highly forward curved blower blades that have nearly radial entry angles (see FIG. 5). This is particularly problematic and can cause air flow instability when the blower is attached to a volume with a restricted outlet area. The restricted flow outlet and the forward curved blower blades can generate a negative damping that causes a Helmholtz resonator-type of oscillation to occur in the system and produce unwanted noise. As such, there is also a need in the art for improved blower blade design that reduces unwanted noise and vibration and improves the efficiency of the blower.

It can therefore be seen that there is a real and continuing need for the development of an improved squirrel cage type blower that reduces noise and vibration and improves efficiency.

The primary objective of the present invention is the provision of an improved squirrel cage type blower that reduces or eliminates the back flow or recirculation of air through the air inlet.

Another objective of the present invention is the provision of an improved squirrel cage type blower that minimizes the vibration and noise and improves efficiency through a more effective blower blade design.

Another objective of the present invention is the provision of a method of reducing the noise and vibration and improving the efficiency of a squirrel cage type blower.

Still another objective of the present invention is the provision of an improved squirrel cage type blower that is efficient in operation, economical to manufacture, and durable in use.

These and other features, objectives, and advantages will become apparent to those skilled in the art with reference to the accompanying specification.

SUMMARY OF THE INVENTION

The foregoing objectives are achieved in the preferred embodiment of the invention by an improved blower of the squirrel cage type that has an end seal ring that substantially encloses the inlet ends of the blower blades so to prevent air accelerated by the impeller from recirculating into the air inlet and onto the inlet ends of the blower blades. In its preferred form, the blower also includes a cylinder that extends from the end seal ring to a point beyond the air inlet to further prevent air from recirculating into the air inlet. In addition, the housing may include at least one axial ring extending generally toward the end seal ring near the air inlet to impede the flow of air back into the air inlet. The blower may also include at least one end seal blade disposed between the end seal ring and the housing. This end seal blade rotates with the impeller to create a counter pressure to force air from the impeller away from the air inlet and the inlet sides of the blower blades.

The present invention also includes an improved blower blade angle design wherein the entry angle of the blade is such that the air flows smoothly onto the blade at a given flow rate. In general, entry angles of approximately 90° are avoided.

BRIEF DESCRIPTION OF THE DRAWINGS

FIG. 1 is a perspective view of the improved blower of the present invention.

FIG. 2 is a cut away exploded perspective view of the blower of FIG. 1.

DETAILED DESCRIPTION OF THE PREFERRED EMBODIMENT

Figure 3:
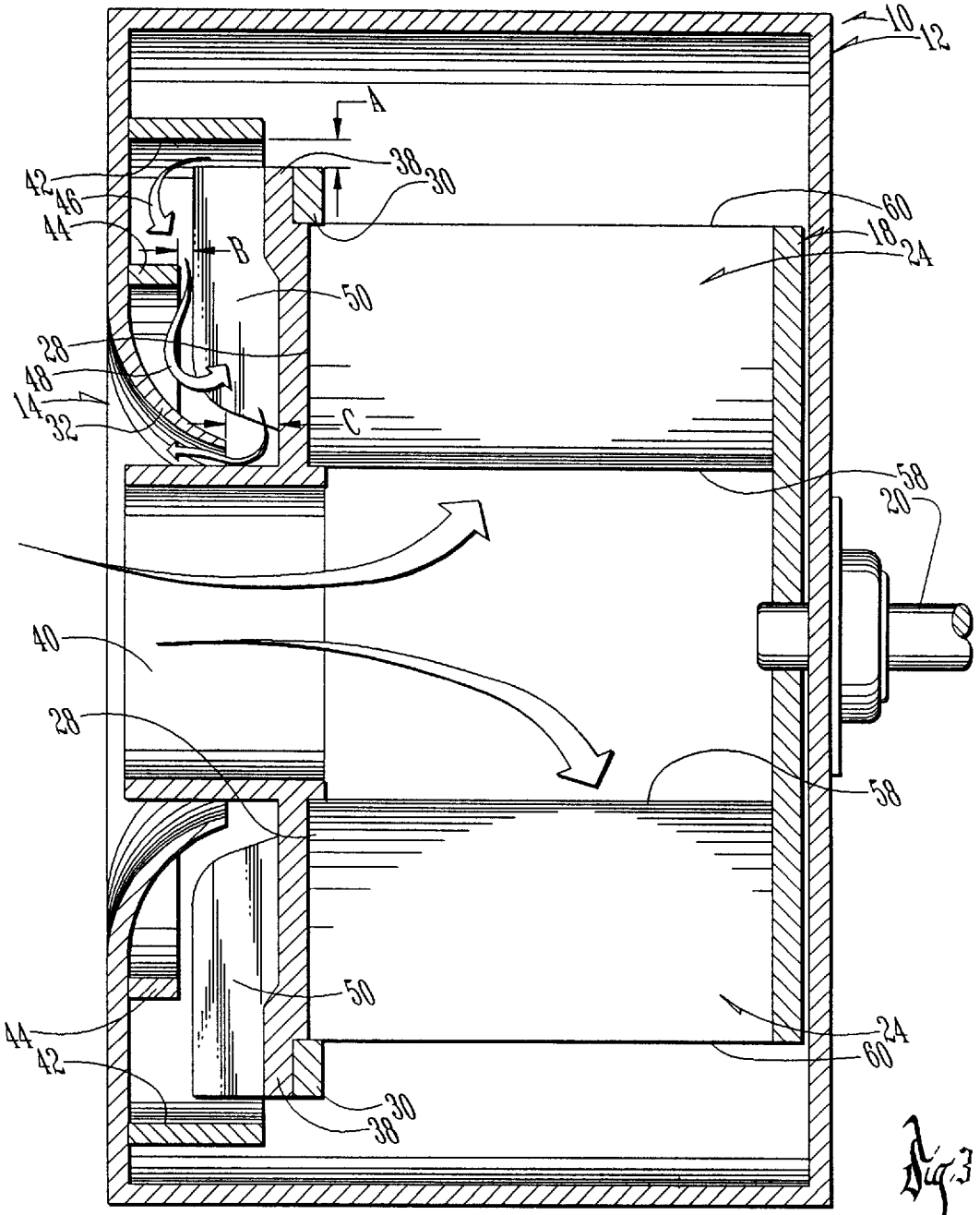
FIG. 3 is a sectional view taken along line 3—3 of FIG. 1.

FIG. 1 shows a squirrel cage type blower 10 of the present invention having a hollow housing 12 that forms an air inlet 14 and an air outlet 16. An impeller 18 is mounted on a shaft 20 and is partially enclosed by the housing 12 (see FIG. 2). The air is drawn in through the air inlet 14 in the direction of the arrow 22 by the rotating impeller 18, which is driven by a motor (not shown) and includes a plurality of blower blades 24 arranged in a series. On flowing through the passages between the blades 24, the air is given an acceleration and emerges under pressure from the housing 12 and through the outlet 16 in the direction of the arrow 26.

Figure 4:
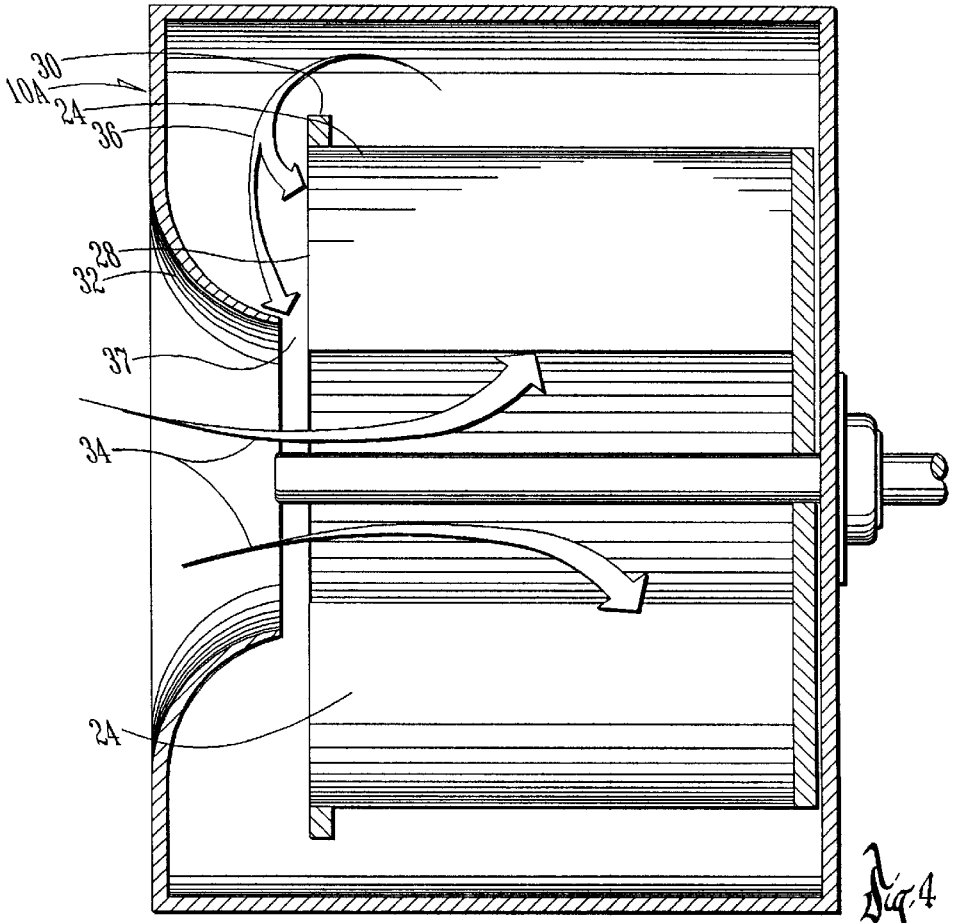
Fig. 4 (PRIOR ART)
FIG. 4 is a sectional view of a prior art blower similar to FIG. 3.

FIG. 4 is a sectional view of a typical prior art squirrel cage blower 10A. Each of the blower blades 24 has an inlet end 28. The inlet ends 28 of the blower blades 24 are spaced apart along the periphery of the outer ring 30.

A standard construction is required to injection mold the outer ring 30 and blower blades 24 as one piece. So that the part can be easily removed from the injection molding die, the outer ring 30 does not cover the inlet end 28 of the blower blade 24. The blower blades 24 also extends past the inlet portion 32 of the housing 12 and into the air inlet 14. This open region allows for a large amount of air flow around the end of the impeller 18. As shown by the directional arrows 34 and 36 in FIG. 4, some of the air that is drawn into the blower through the air inlet 14 flows around the end of the impeller 18 and through the gap 37 created between the inlet portion 32 of the housing 12 and the impeller 18 and back onto the blower blades 24 through the air inlet 14. This causes chaotic air flow to the blower blades 24, which in turn creates unwanted noise and vibration and impedes the performance of the blower 10.

The improved blower 10 of the present invention is shown most clearly in FIGS. 2 and 3. To eliminate or minimize the amount of air that recirculates from the impeller 18 back through the air inlet 14, an end seal ring 38 is provided that encloses the inlet ends 28 of the blower blades 24. The inlet portion 32 of the housing 12 also encloses a larger portion, if not all of, the blower blades 24. As shown in FIG. 3, the end seal ring 38 fits in a mating relationship with the outer ring 30 and covers the remaining portions of the inlet ends 28 of the blower blades 24. It is important that the end seal ring 38 has an outer diameter greater than equal to the diameter of the impeller 18.

The end seal ring 38 is preferably made from a plastic material and can be attached to the outer ring 30 and inlet edges 28 of the blades 24 using an adhesive or snap-on fastening mechanism.

An inner cylinder 40 is also provided that extends from the end seal ring 38 to beyond the inlet portion 32 of the housing 12. The inner cylinder 40 functions to direct the back flow of air outside the blower 10 before it circulates back through the air inlet 14. That is, the inner cylinder 40 forces any leakage air to flow axially outward before it can turn around and re-enter the air inlet 14. In its preferred form, the inner cylinder 40 and end seal ring 38 are integrally formed.

As a further means to impede or prevent the flow of air from recirculating into the air inlet 14, axial rings 42 and 44 are provided which cause the back flow of air to pass through a tortious path, and hence, retards or impedes the flow. The axial rings 42 and 44, as shown in FIG. 3, extend from the housing 12 and generally toward the end seal ring 38. These axial rings 42 and 44 may be molded as part of the housing 12. The inlet portion 32 of the housing 12 similarly functions to retard the recirculatory air flow.

A plurality of end seal blades 50 are also disposed on the end seal ring 38 between the housing 12 and impeller 18. The end seal blades 50 have a short axial length with either a radial or curved surface and create a small blower that produces a counter pressure that forces leakage air to flow back toward the air outlet 16 and away from the air inlet 14. The end seal blades 50 cause the air to flow around inside of the housing in circular paths between axial rings 42 and 44 to prevent end leakage, as shown by directional arrows 46 and 48. This construction also prevents serious chaotic inlet flow to the blower blades 24.

Another important aspect of the present invention is that the clearances or gaps (A and B) between the axial rings 42 and 44 and the end seal blade 50 can be quite generous. The same is true of the gap (C) between the inlet portion 32 of the housing 12 and the end seal ring 38. As such, the manufacturing tolerances can be quite large without reducing the effectiveness of the design.

Figure 5:
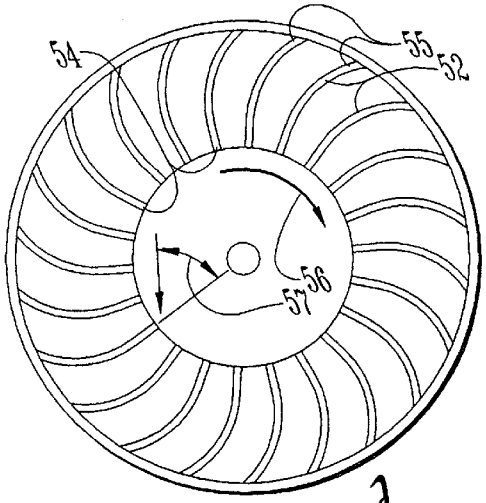
Fig. 5 (PRIOR ART)
FIG. 5 is a side elevational view of a prior art impeller.

In combination with the previously mentioned improvements, it is also important to maintain good blower blade design. As shown in FIG. 5, the blower blades 52 of prior art impellers often have radial entry surfaces 54 and highly forward (in the direction of rotation 56) curved exit surfaces 55. The air flows relative to the blower blade 52 at a highly inclined angle 57 to the entry surface 54 of the blade 52 at all flow rates. This large angle causes turbulence and noise as the air tries to enter the flow channels between adjacent blades 52. The forward curved blade design can lead to a pressure versus flow rate blower characteristic curve that generates negative damping and instability when the blower is connected to a volume with a restrictive flow inlet or outlet. This is often referred to as a Helmholtz resonator-type of flow oscillation which produces unwanted noise.

Figure 6:
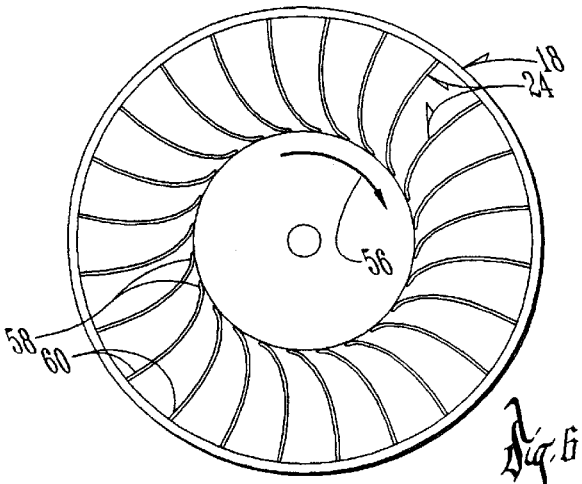
FIG. 6 is a side elevational view of the impeller of the present invention.

The blower blade design of the present invention, as shown in FIG. 6, solves this problem. Note that the entry surface 58 of the blower blade 24 is positioned such that the air flows nearly parallel to the entry surface and smoothly onto the blower blade 24 so that the angle 57 is zero at the design flow rate and small over a range of flow rates. This small angle provides for smooth flow onto the blades 54 at the entry surface 58. The exit surface 60 of the blower blade 24 is nearly radial. It is important that the blower blade have enough forward curve to overcome the well-known slip phenomenon, but also that the pressure versus flow rate curve does not have a positive slope over any flow range. The positive slope can cause the Helmholtz resonator problem to occur.

As the invention has been shown and described in connection with its preferred embodiment thereof, it will be understood that many modifications, substitutions, and additions may be made which are within the broad scope of the following claims. For example, although the present invention has been described it relates to the circulation of air, the blower may be used to circulate any other gas as well.

In the foregoing, it can be seen that the present invention accomplishes at least all of the stated objectives.

What is claimed is:

1. An improved blower of the squirrel cage type that includes a hollow housing having an air inlet and an air outlet, and a rotating impeller mounted on its axis within said housing, said impeller having an outer ring and a plurality of blower blades each with an inlet end, said inlet ends of said blades spaced apart along the periphery of said outer ring adjacent said air inlet, said improvement comprising:

an end seal ring that substantially encloses said inlet ends of said blower blades so to prevent air accelerated by said impeller from recirculating into said air inlet.

2. The improved blower of claim 1 wherein said end seal ring providing a covering for said outer ring and said outlet ends of said blower blades.

3. The improved blower of claim 1 further comprising a cylinder extending from said end seal ring and beyond said air inlet to further prevent air accelerated by said impeller from recirculating into said air inlet.

4. The improved blower of claim 3 wherein said end seal ring and said cylinder are integrally formed.

5. The improved blower of claim 1 wherein said housing having at least one axial ring extending therefrom and generally toward said end seal ring to impede the flow of air from said impeller that is recirculating into said air inlet.

6. The improved blower of claim 1 further comprising at least one end seal blade disposed between said end seal ring and said housing to create a counter pressure to force air from said impeller away from said air inlet and said inlet sides of said blower blades.

7. The improved blower of claim 1 wherein said blower blade having an exit portion nearly radial to said outer ring.

8. The improved blower of claim 3 wherein said housing having at least one axial ring extending therefrom and generally toward said end seal ring to impede the flow of air from said impeller that is recirculating into said air inlet.

9. The improved blower of claim 8 further comprising at least one end seal blade disposed between said end seal ring and said housing to create a counter pressure to force air from said impeller away from said air inlet and said inlet sides of said blower blades.

10. The improved blower of claim 5 further comprising at least one end seal blade disposed between said end seal ring and said housing to create a counter pressure to force air from said impeller away from said air inlet and said inlet sides of said blower blades.

11. The improved blower of claim 3 further comprising at least one end seal blade disposed between said end seal ring and said housing to create a counter pressure to force air from said impeller away from said air inlet and said inlet sides of said blower blades.

12. A method of reducing noise and vibration and improving the efficiency of a blower of the squirrel cage type that includes a hollow housing having an air inlet and an air outlet, and a rotating impeller mounted on its axis within said housing, said impeller having an outer ring and a plurality of blower blades each with an inlet end, said inlet ends of said blades spaced apart along the periphery of said outer ring adjacent said air inlet, said method comprising:

providing an end seal ring that substantially encloses said inlet ends of said blower blades so to prevent air accelerated by said impeller from recirculating into said air inlet.

13. The method of claim 12 further comprising the step of providing a cylinder extending from said end seal ring and beyond said air inlet to further prevent air accelerated by said impeller from recirculating into said air inlet.

14. The method of claim 12 further comprising the step of providing at least one axial ring extending from said housing and generally toward said end seal ring to impede the flow of air from said impeller that is recirculating into said air inlet.

15. The method of claim 12 further comprising the step of providing at least one end seal blade disposed between said end seal ring and said housing to create a counter pressure to force air from said impeller away from said air inlet and said inlet sides of said blower blades.

16. A blower of the squirrel cage type comprising:

a hollow housing having an air inlet and an air outlet;

a rotating impeller mounted on its axis within said housing, said impeller having an outer ring and a plurality of blower blades each with an inlet end, said inlet ends of said blades spaced apart along the periphery of said outer ring adjacent said air inlet; and an end seal ring that substantially encloses said inlet ends of said blower blades so to prevent air accelerated by said impeller from recirculating into said air inlet.

* * * * *